US006119922A

United States Patent [19]

Hall, Jr.

[11] Patent Number: 6,119,922

[45] Date of Patent: Sep. 19, 2000

[54] METHOD FOR MAKING MINERAL INSULATED CABLE

[75] Inventor: Bertie Forrest Hall, Jr., Ann Arbor, Mich.

[73] Assignee: Hoskins Manufacturing Company, Detroit, Mich.

[21] Appl. No.: 09/193,531

[22] Filed: Nov. 17, 1998

[51] Int. Cl.[7] ..... H01B 7/02; H01B 13/06; H01B 13/22; B03C 1/015; B03C 1/02

[52] U.S. Cl. ..... 228/148; 156/47; 209/219; 29/825

[58] Field of Search ..... 156/47, 51; 174/118, 174/120 P; 209/218, 219, 220, 221, 222; 228/148; 29/825

[56] References Cited

U.S. PATENT DOCUMENTS

| | | | |
|---|---|---|---|
| 3,327,852 | 6/1967 | Mortsell | 209/219 |
| 3,737,822 | 6/1973 | Buus et al. | 335/304 |
| 4,420,881 | 12/1983 | Bourget | 29/285 |
| 4,512,827 | 4/1985 | Gill . | |
| 4,629,110 | 12/1986 | Holmgren et al. . | |
| 4,739,155 | 4/1988 | Rodgers et al. | 219/537 |
| 5,092,986 | 3/1992 | Feistner et al. | 209/212 |
| 5,328,086 | 7/1994 | Hall, Jr. . | |
| 5,346,116 | 9/1994 | Hall, Jr. . | |
| 5,453,599 | 9/1995 | Hall, Jr. . | |
| 5,464,485 | 11/1995 | Hall, Jr. . | |
| 5,479,690 | 1/1996 | Hall, Jr. . | |
| 5,660,805 | 8/1997 | Reeves et al. | 423/83 |

FOREIGN PATENT DOCUMENTS

| | | |
|---|---|---|
| 60-46869 | 5/1984 | Japan . |

*Primary Examiner*—Michael W. Ball
*Assistant Examiner*—John T Haran
*Attorney, Agent, or Firm*—Brooks & Kushman P.C.

[57] ABSTRACT

A method for making mineral insulated cables in which a mineral powder is purified to remove magnetic particles. The purified mineral powder and at least one wire are fed into a seam-welded metal sheath as it is being formed to produce the mineral insulated cable. The mineral insulated cable may then be drawn and annealed to reduce the diameter of the cable to the desired size.

10 Claims, 7 Drawing Sheets

METHOD FOR MAKING MINERAL INSULATED CABLE

TECHNICAL FIELD

The invention is related to processes for making highly reliable mineral insulated cable for use as a thermocouple.

BACKGROUND ART

Various methods or processes for making mineral insulated cables, as well as cable making mechanisms, are well known in the art, as well as cable making mechanisms. Typical examples of such mechanisms are taught by Hall, Jr. in U.S. Pat. Nos. 5,346,116 and 5,479,690. Further examples are taught by Japanese patent application No. SHO 46869, Gill in U.S. Pat. No. 4,629,110 and Holmgren et al. in U.S. Pat. No. 4,269,110. The art continues to improve the manufacturing processes and the quality and reliability of the final product.

DISCLOSURE OF INVENTION

The process disclosed produces a high quality and reliable mineral insulated cable and in particular the manufacture of a mineral insulated cable used as a thermocouple. The process begins with purification of the mineral powder to remove contaminants such as iron, iron oxide, and moisture prior to use. The process then forms a welded seam metal sheath into which at least one wire and the mineral powder are inserted at a location downstream of the location where the seam is welded to produce the mineral insulated cable. The mineral insulated cable is then cold drawn and annealed at least once to reduce the diameter of the cable and compact the mineral powder to structurally support the wires inserted into the sheath and electrically isolate them from each other and the internal surface of the sheath.

The mineral powder is purified by magnetically separating magnetic particles, such as iron particles from the mineral powder, reducing the separated mineral powder in a hydrogen atmosphere at an elevated temperature to transform the iron oxides to metallic particles, then again separating the iron particles from the mineral powder before insertion into the sheath during the fabrication of the cable.

One object of the invention is a method for continuously producing high quality mineral insulated cable.

Another object of the invention is to purify the mineral powder prior to insertion into the metal sheath.

Still another object of the invention is to provide a process which may be stopped to repair or replace a worn or broken arc weld electrode or provide a new source of wires or metal strips without affecting the quality of the produced cable.

These and other objects of the invention will become more apparent from a reading of the specification in conjunction with the drawings.

DETAILED DESCRIPTION OF THE PREFERRED EMBODIMENT

Figure 1:
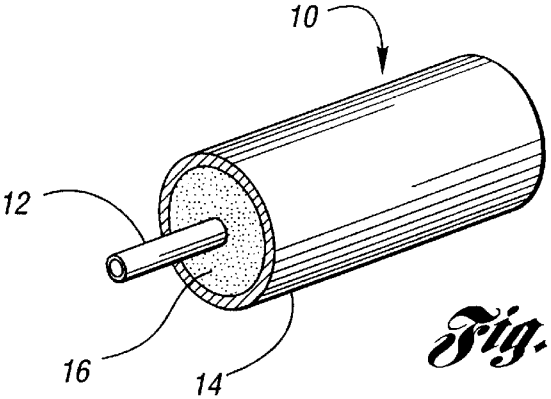
FIG. 1 is a perspective view of a mineral insulated cable.

The method for making a mineral insulated cable, as shown in FIG. 1, will be discussed with reference to the apparatus disclosed in U.S. Pat. No. 5,479,690 issued to Hall, Jr. on Jan. 2, 1996 and in U.S. Pat. No. 5,346,116 issued to Hall, Jr. on Sep. 13, 1994., each of which patents being incorporated herein by reference.

Figure 2:
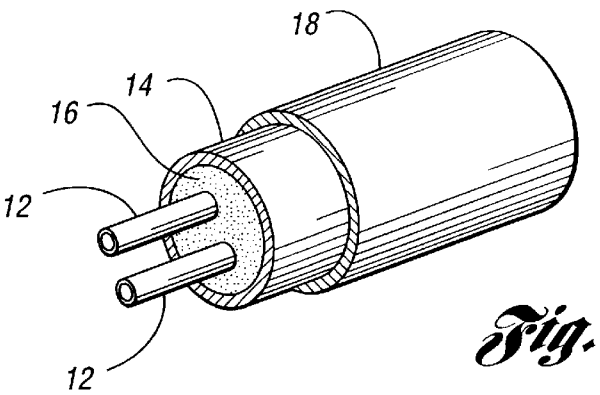
FIG. 2 is a perspective view of a mineral insulated cable having two wires and two sheaths.

Referring first to FIGS. 1–2, the product of the disclosed method, a mineral insulated cable 10, has one or more wires 12 enclosed in a metal sheath 14. The wires 12 are insulated from each other and from the metal sheath by a mineral or non-conductive ceramic powder 16. As shown in FIG. 2, the mineral insulated cable 10 may have two or more wires 12. In the embodiment shown on FIG. 2, the sheath 14 is overlaid with a second or outer metal sheath 18 for added protection and to minimize the effects of weld defects. In the intended application, the wires 12 are metals or alloys normally used for thermocouples and the sheaths are preferably made from a corrosion-resistant, malleable metal.

Figure 3:
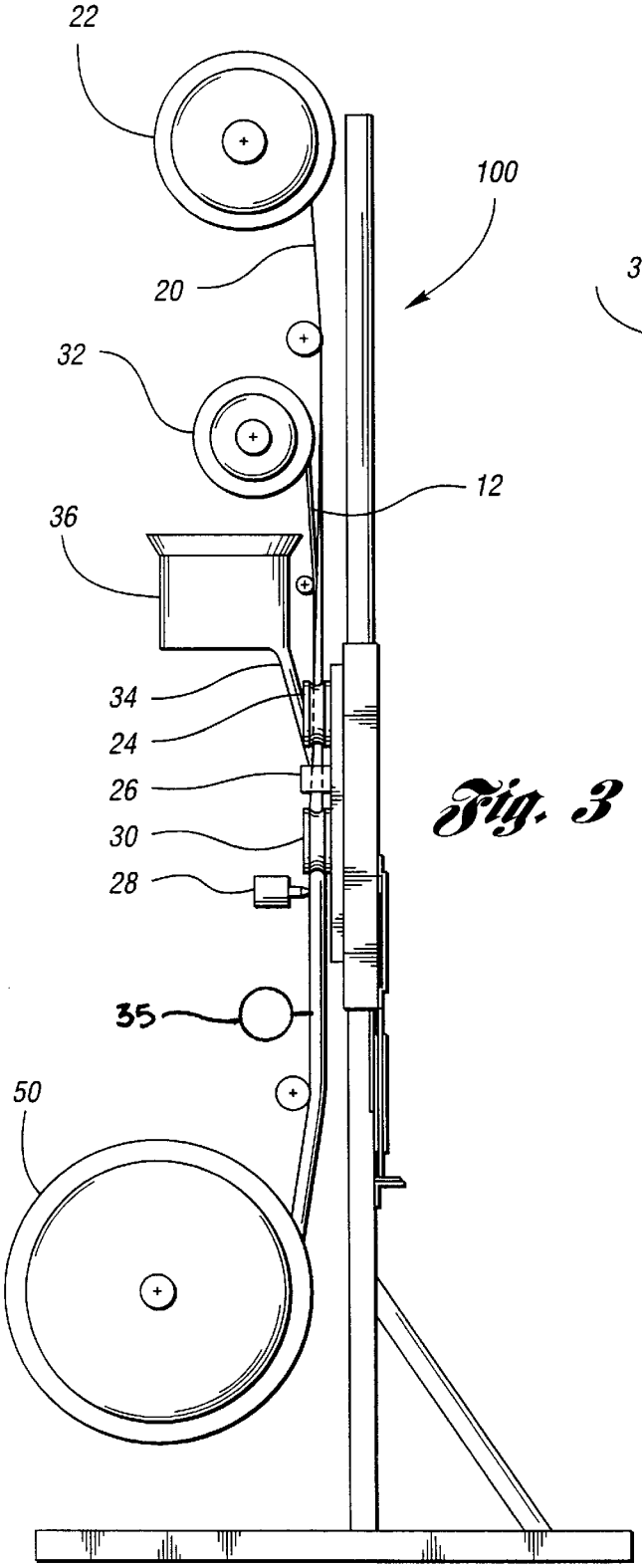
FIG. 3 is a side view of the cable forming apparatus.

Referring now to FIG. 3, the structure of tube forming apparatus 100 for making the mineral insulated cable 10 is shown. In the tube making process, a flat metal strip 20 from a feed reel 22 is formed by one or more forming rolls, illustrated by forming rolls 24, into a generally cylindrical configuration. An anti-twist mechanism and seam guide 26 remove the twist induced in the formed metal strip during the forming process and align opposite linear sides of the formed metal strip with an electrode of an arc welder 28. A pair of closing rolls 30 complete the closing of the cylindrical configuration of the formed metal strip 20 such that the opposite sides thereof are in intimate contact with each other. At this juncture, the opposite edges of the metal strip 20 are welded to each other by the arc welder 28 to form the metal sheath 14.

Figure 4:
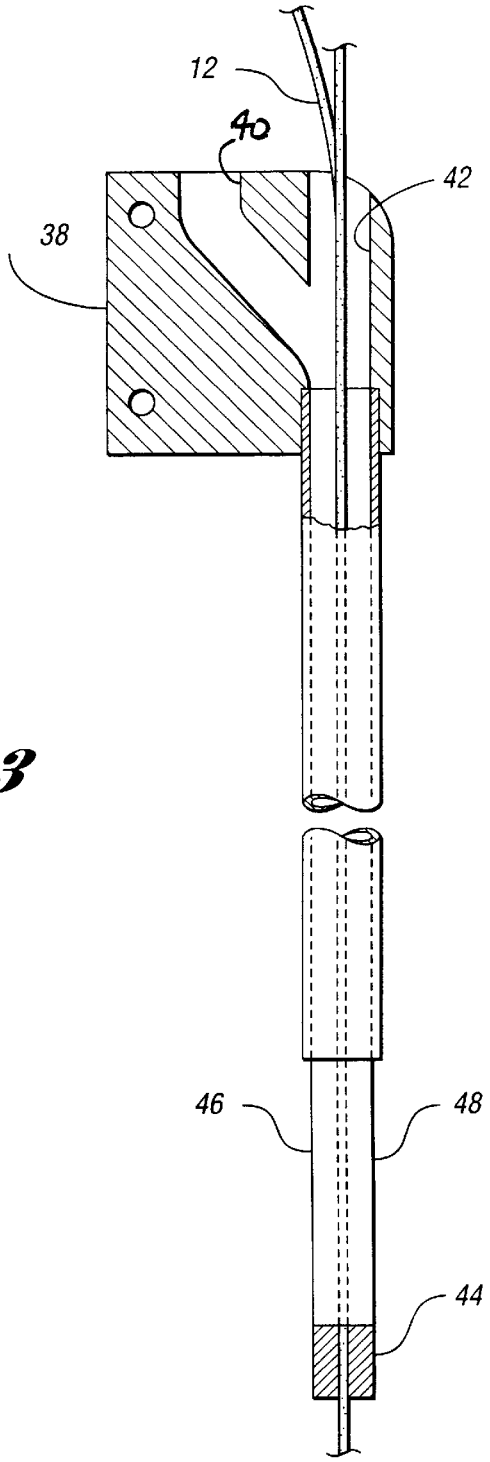
FIG. 4 is a cross-sectional side view of the fill tube.

Simultaneously, one or more wires 12 from a wire reel or reels 32 are guided into a fill tube 34 which extends into the seam-welded metal sheath 14 to a location at least three inches downstream of the welding head of the arc welder 28, as shown in FIG. 3. The fill tube 34 receives the mineral powder 16 from a hopper 36 which should be heated to a temperature of about 400° F. to exclude moisture. As more clearly shown in FIG. 4, the fill tube 34 has a head 38 having interconnected internal passages 40 and 42. Internal passage 40 has one end connected to the hopper 36 and the opposite end connected to internal passage 42. Internal passage 42 receives the wire or wires 12 from the wire reel 32. A wire guide 44 is provided at the opposite or lower end of the fill tube 34, which positions the wire or wires 12 relative to each other and to the internal walls of the metal sheath 14. Powder exit slots 46 and 48 are provided at the lower end of the fill tube 34 as shown, which allow the mineral powder to flow from the fill tube 34 into the metal sheath 14. To facilitate the flow of the mineral powder through the fill tube 34 and into the sheath 14, a vibrator 35 vibrates the fill tube continuously at a selected frequency, such as 60 cycles/sec. This vibrator initiates the compaction of the mineral powder in the sheath 14.

The structure of the fill tube 34 is discussed in greater detail in U.S. Pat. No. 5,479,690 issued to Hall, Jr. on Jan. 2, 1996.

The mineral insulated cable 10 consisting of the metal sheath 14 and enclosing one or more wires 12 is filled with a mineral medium 16 such as a ceramic oxide (e.g. magnesium oxide) either in powder or pelletized form which is subsequently granulated. (Other types of mineral or ceramic insulator or nonconducting material may be used, e.g. boron nitride, aluminum nitride, calcium sulfide and the like.) The cable 10 is then wound on a take-up spool 50. In one embodiment, the mineral insulated cable 10 may subsequently be overlayed with a second sheath 18 compatible with the tube-making apparatus discussed above. To reduce the diameter of the cable 10 to a desired size, it may be cold drawn, then annealed one or more times as discussed hereinafter. This reduction of the cable diameter also compacts and internally supports the cable within the metal sheath.

Figure 5:
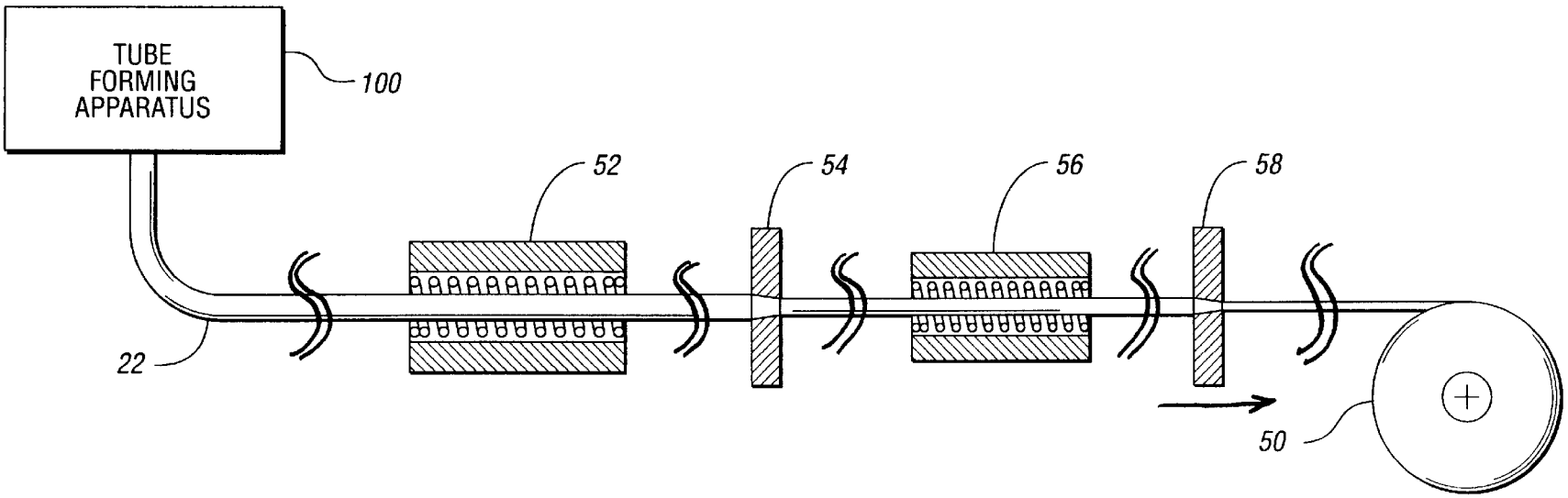
FIG. 5 is a schematic of the separate annealing and cold drawing steps in manufacture of the mineral insulated cable.

In the alternative to winding the mineral insulated cable 10 directly on the take-up spool 50 as described relative to FIG. 3, the cable 10, as it exits the tube forming apparatus 100 may be cold drawn through at least a first diameter reducing die 54 and annealed in an annealing oven 52, as shown in FIG. 5. The drawn cable 10 may further be drawn through at least a second diameter reducing die 58 and furnace 56 before being wound on a take-up spool. The process of cold drawing and annealing may be repeated as many times as required to reduce the diameter of the mineral insulated cable 10 to the desired size. The length of the annealing ovens 54,58 is selected so that the forming of the mineral insulated cable 10, the cold drawing and the annealing are one continuous process. Though the arrangement of FIG. 5 depicts the drawing and annealing steps to be in-line, it will be apparent to those of ordinary skill in the art that such steps may be undertaken separately in relative isolation from each other.

Figure 6:
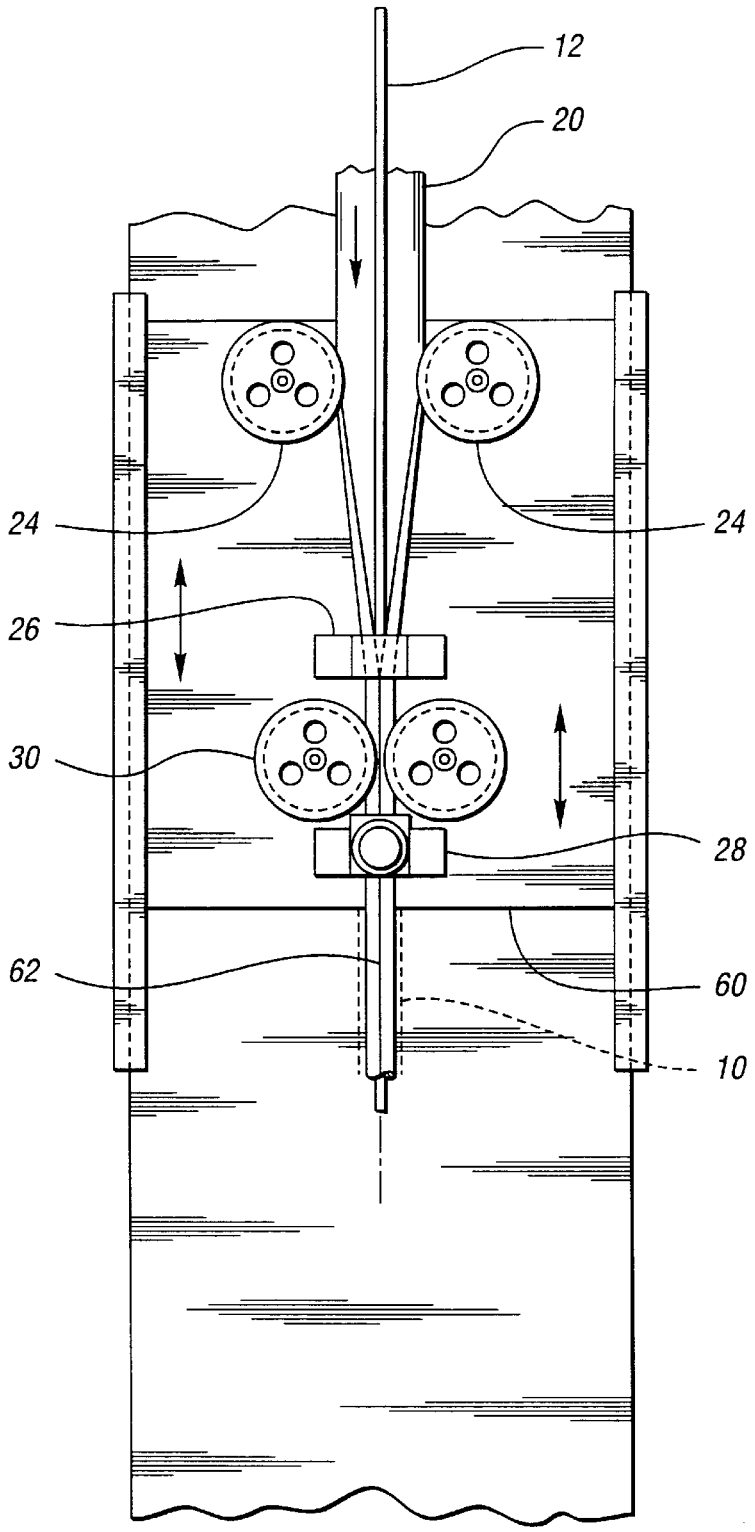
FIG. 6 is a front view of a tube forming apparatus having a movable base.

In the manufacturing process, it may be necessary to stop the tube forming apparatus 100 to replace or sharpen the electrode of the arc welder 28, to replace empty feed reel 22 or wire reel 22 with full reels of new material. To accommodate these stoppages, the arc welder 28, the closing rolls 30, and at least one set of forming rolls 24 may be mounted on a movable base 60 as shown in FIG. 6. Upon stoppage of the tube forming process for any reason, the base 60 may be displaced from its normal operation position linearly a predetermined distance to a stop position downstream of the stopped sheath 14, such that the electrode of the arc welder 28 overlays a previously welded portion of the welded seam 62. In the stopping of the tube-forming process, electrical power to the electrode of the arc welder 28 is turned off to prevent damage to the underlying welded tube. Upon restarting of the tube forming apparatus 100, the movable base 60 is slowly displaced from the stop position back to the normal operating position. As the base 60 is moved back to its normal operating position, the arc welder 28 is turned on and it will overweld the previous welded seam 62, then continue to weld the seam in a normal manner without any defects in the welded seam 62 due to the stoppage. The base 60 may be manually, electrically, pneumatically, or hydraulically moved as discussed in U.S. Pat. No. 5,346,116.

Figure 7:
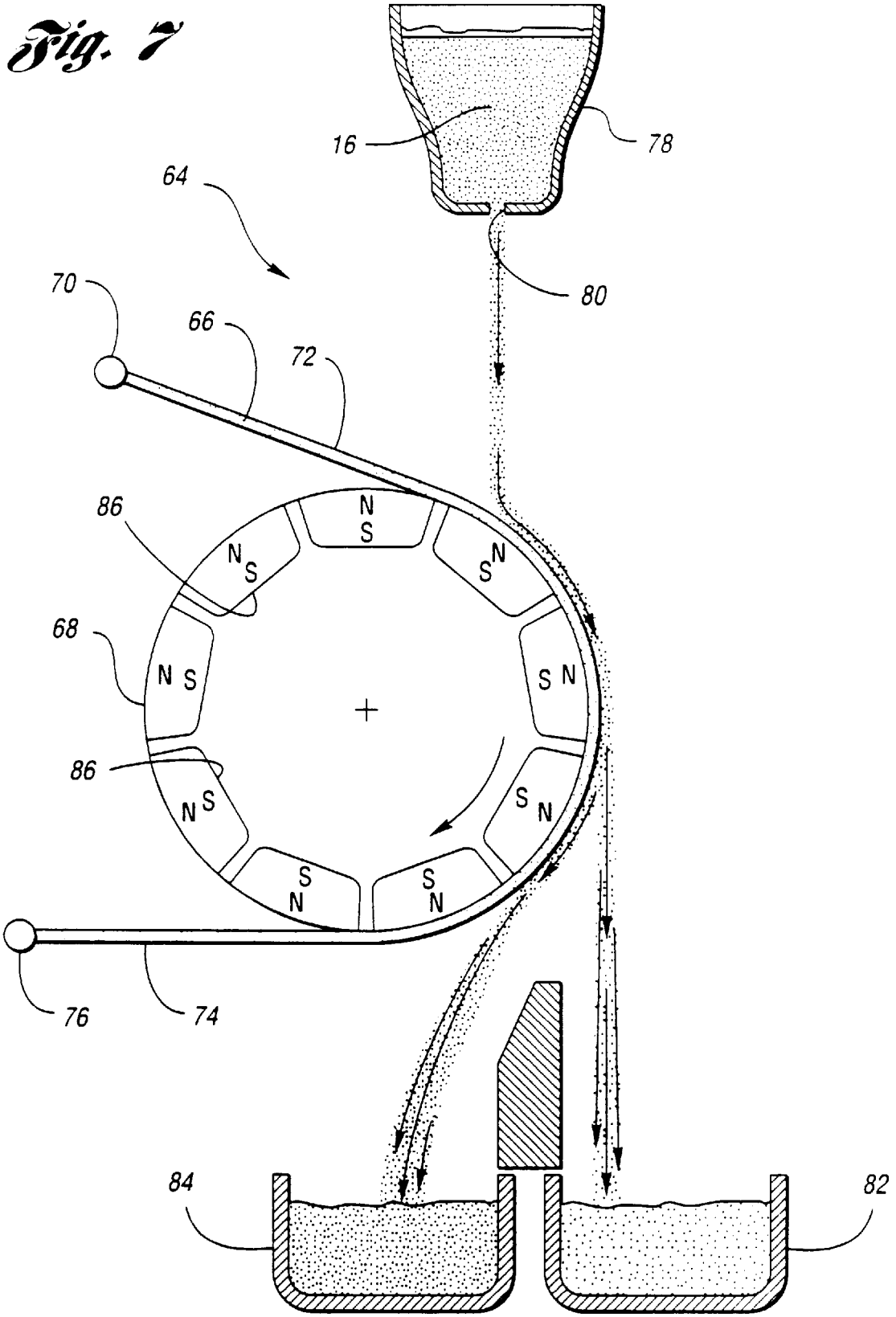
FIG. 7 is a side view of the separator.

It has been found that the iron and iron oxide content of the mineral powder 16 used to fill the metal sheath 14 may be detrimental to the stability of a thermocouple element made using the above process. It further has been found that the current methods used by the manufacturers of the mineral powder to remove the iron and iron oxide contaminants is unsatisfactory. To further separate and remove the unwanted iron and iron oxide particles from the mineral powder 16, the separator 64 shown in FIG. 7 has been found to be very effective. The separator 64 has a durable, tear-resistant, stationary thin non-magnetic film such as a MYLAR® or a plastic (or rubber) film 66, approximately 1/1000 inches thick, draped over a rotating magnet drum 68. The top end of the film 66 is attached to a fixed upper structural member 70 such that the upper portion 72 of the film 66 is pitched at approximately 0–30° relative to the horizontal. The lower portion 74 of the fixed film 66 is attached to a lower stationary member 76 and extends at an angle of about 30° below a horizontal plane such that the lower stationary member 76 lies below the point of departure of the film from the drum. Mineral powder 16 stored in a hopper 78 flows from an exit slot 80 onto the stationary film 66 at a location offset from the axis of the rotating magnetic drum 68. The nonmagnetic powdered mineral particles will flow by gravity about the curved forward surface of film 66 and fall substantially vertically into a first container 82. The iron and iron oxide particles attracted to the rotating magnetic drum 68 will be deflected by the magnetic field into a second container 84. The magnetic drum 68 is made from a plurality of permanent magnets 86 approximately equally spaced about its periphery.

The particle separation process may be enhanced by reducing the first separated mineral powder in a reducing atmosphere (e.g., hydrogen, H—N mixtures, cracked ammonium, etc.) at an elevated temperature of approximately 1000° C. to reduce the iron oxides to metallic iron particles and water, then repeat the separation process using the separator 64 described above. Tests have shown that the iron and iron oxide content of the mineral powder was reduced from about 0.06% as originally received to about 0.04% after a first separation using the above-described separator and to about 0.03% after reduction in a hydrogen atmosphere and a second magnetic separation. (In this specification, all percentages are expressed as percent by weight.)

Figure 8:
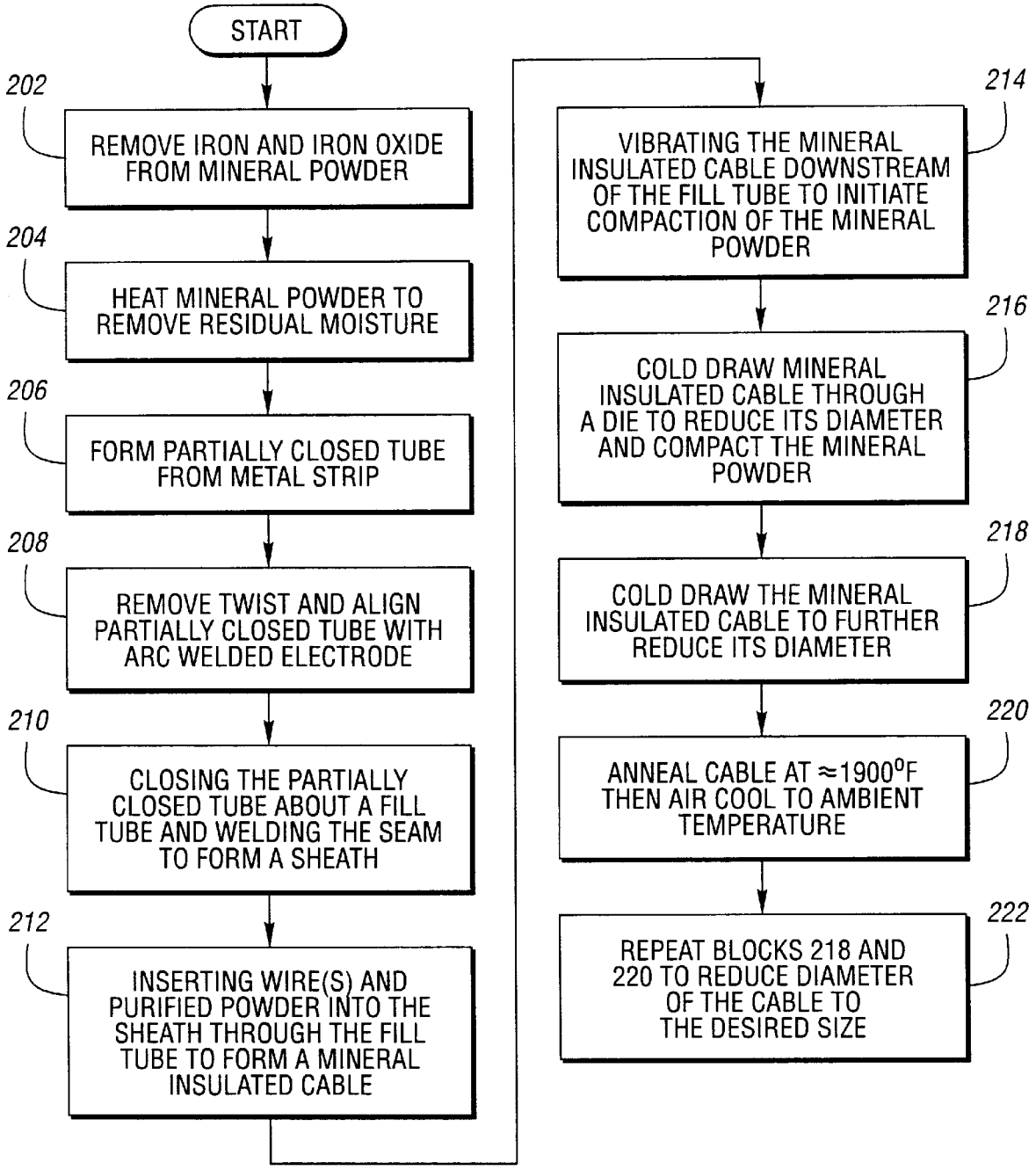
FIG. 8 is a flow diagram of the insulated cable manufacturing process.

The process 200 of forming the mineral insulated cable 10 is recapitulated with reference to the flow diagram shown on FIG. 8. The process begins by the removal of the iron and iron oxide particles from the mineral powder as indicated by block 202. After removal of the iron and iron oxide particles, the mineral powder is heated, block 204, to remove any residual moisture. The process then continuously forms a partially closed tube from a metal strip as indicated by block 206. The partially closed tube is then passed through an anti-twist mechanism and alignment tool, block 208, to remove any twist in the partially formed tube during its formation and to align the edges of the partially formed tube with the electrode of the arc welder 28. The partially closed tube is then closed about a fill tube and welded closed, as indicated by block 210, to form a sheath. At least one wire and the purified mineral powder are inserted into the sheath through the fill tube to form the mineral insulated cable 10 as indicated by block 212. The mineral insulated tube 10 is then vibrated by one or more vibrators (preferably at about 60 cps) at a location downstream of the fill tube to initiate the compaction of the mineral powder in the sheath as indicated by block 214.

Subsequently, the cable 10 is cold drawn through a lubricated die as indicated in block 216, to reduce its diameter and further compact the mineral powder. A gear reduction motor driving a capstan pulls the cable 10 through the die and gathers the drawn cable thereon.

The drawn cable may subsequently be drawn through a single head wire drawing machine, block 218, to further reduce the diameter cable. The cable 10 is then annealed at approximately 1900° F., then air cooled to ambient temperature as indicated by block 220. The alternate steps of drawing and annealing, blocks 218 and 220 respectively are repeated until the mineral insulated cable 10 is reduced to a desired diameter as indicated by block 222.

Figure 9:
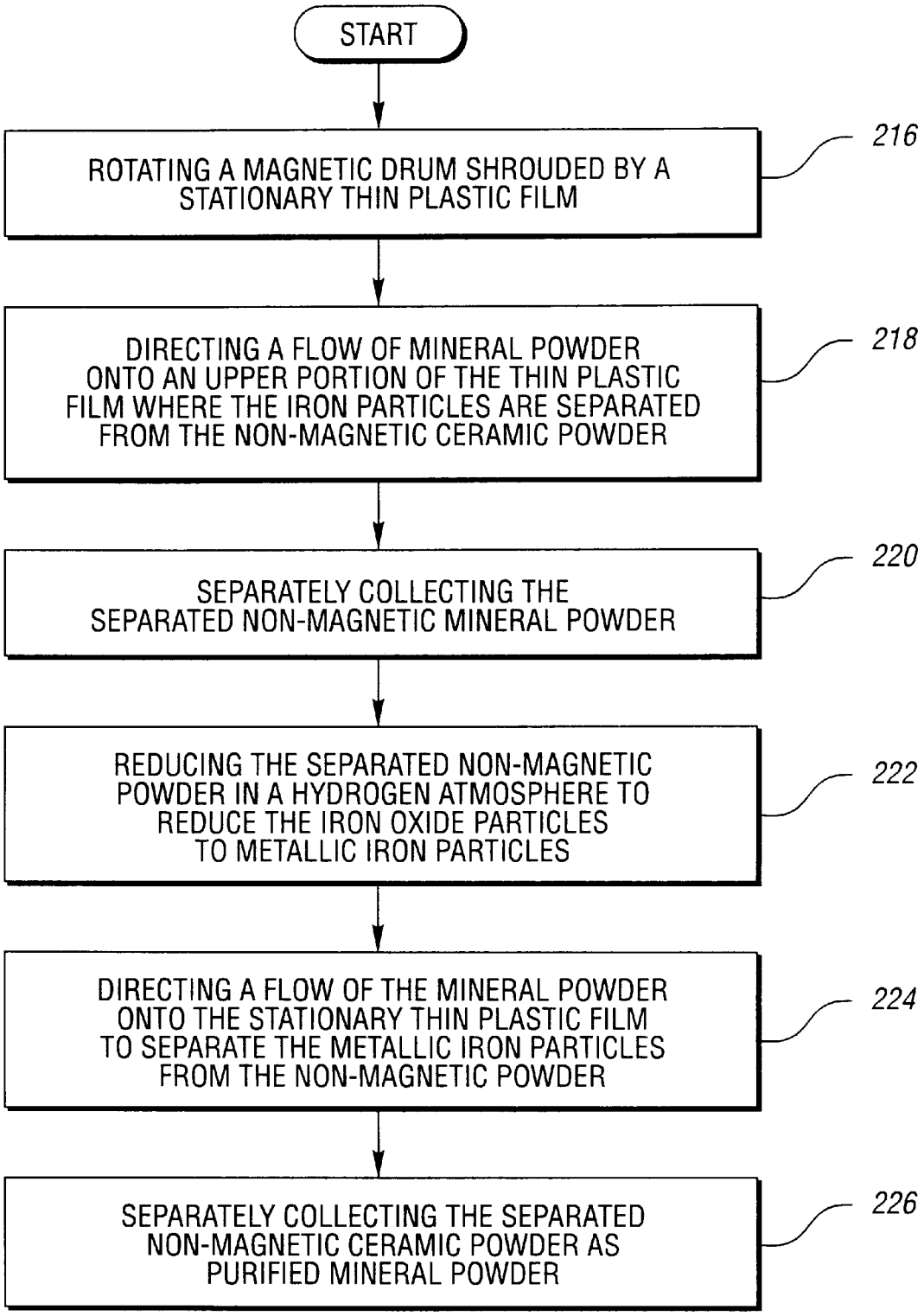
FIG. 9 is a flow diagram of the process which includes the addition of a second sheath.

To minimize the effects of weld defects on the performance of the mineral insulated cable 10, the process may include the additional step of applying a second sheath 18 over the mineral insulated cable 10 as indicated by block 224 on FIG. 9. Preferably, the welded seams of the first or inner sheath and the welded seam of the second or outer sheath are in opposite quadrants. Except for the addition of the second sheath, block 224, the process shown on FIG. 9 is identical to the process shown on and described with reference to FIG. 8.

Figure 10:
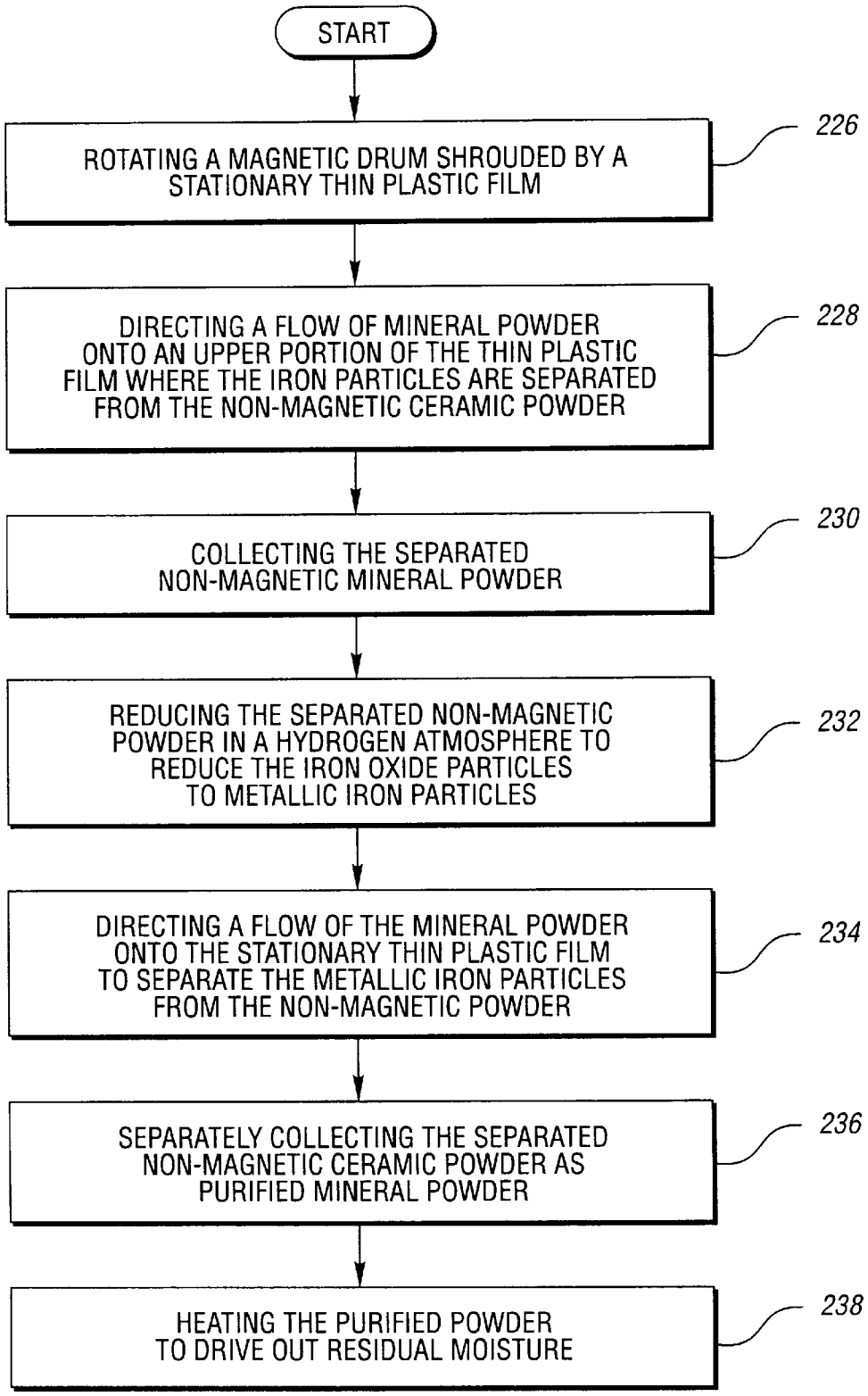
FIG. 10 is a flow diagram of the mineral powder purification process.

The details of the process for separating the iron and iron oxide particles from the mineral powder 16 prior to filling the metal sheath 14 will be discussed relative to the flow diagram shown in FIG. 10. The process begins by rotating a magnetic drum shrouded by a stationary plastic film such as a thin MYLAR® film as indicated by block 226. A flow of mineral powder 16 is then directed onto an upper portion of the stationary plastic film at a location such that the mineral powder will flow by the force of gravity along the curved contour of the plastic film defined by the magnetic drum as indicated by block 228. The iron particles in the mineral powder will be attracted by the magnetic field of the rotating magnetic drum through the plastic film and will separate from the plastic film at a location different from the non-magnetic mineral powder. The non-magnetic powder, after the removal of the iron particles, is separately collected as indicated by block 230.

The separated non-magnetic mineral powder is then reduced in a hydrogen atmosphere at an elevated temperature (approximately 1000° C.) to reduce the iron oxides to metallic iron particles and water as indicated by block 232. A flow of the reduced mineral powder is then directed onto the stationary plastic film where the metallic iron particles resulting from the hydrogen reduction are removed from the flow of powder by the magnetic attraction of the rotating magnetic drum as indicated by block 234. Finally, the purified mineral powder is collected, block 236, and then heated, block 238, to drive out any moisture that may have been absorbed by the mineral powder from the atmosphere. The purified and demoisturized mineral powder is subsequently used for filling the sheath as discussed relative to FIG. 3.

It is recognized that those skilled in the art may make certain changes or improvements to the process for making mineral insulated cables within the scope of the appended claims. It is not intended to limit the invention to the disclosed process or the tube making apparatus specifically shown in the drawings and discussed in the specification.

What is claimed Is:

1. A method for making a mineral insulated cable comprising;

magnetically separating magnetic particles from a mineral medium to produce a once purified mineral medium containing iron oxide particles;

reducing the once purified mineral medium in a hydrogen atmosphere to convert the iron oxide particles to iron particles;

magnetically separating the iron particles from the reduced mineral medium to produce a purified mineral medium;

forming a seam-welded metal sheath from a metal strip; and inserting at least one wire and the purified mineral medium into the seam-welded metal sheath to produce a length of mineral insulated cable.

2. The method of claim 1 further including after said step of inserting, the following steps:

cold drawing the mineral insulated cable to reduce its diameter;

annealing the drawn mineral insulated cable as it passes through at least one annealing oven; and repeating the steps of cold drawing and annealing said mineral insulated cable until the diameter of said mineral insulated cable has been reduced to a desired size.

3. The method of claim 1 including forming a second metal sheath over said first metal sheath.

4. The method of claim 3 wherein the first and second sheaths have welded seams and wherein the welded seam of the second sheath is located in a quadrant opposite the welded seam of the first sheath.

5. The method of claim 1 wherein the step of forming a seam-welded metal sheath imparts a twist in the metal sheath, said step further including the steps of:

removing the twist imparted to the metal sheath prior to welding the seam; and aligning the edges of the metal strip in relation to an arc welder electrode prior to welding the seam.

6. The method of claim 1 wherein said at least one wire and said purified mineral powder are inserted into the seam-welded sheath by a fill tube at a location downstream of an arc welder, the method further including the step of vibrating the mineral insulated cable at a location downstream of the fill tube to initiate compaction of the mineral powder.

7. The method of claim 1 wherein the step of forming a seam-welded metal sheath comprises the step of continuously forming the seam-welded sheath.

8. The method of claim 1 wherein the step of inserting at least one wire comprises the step of continuously inserting the at least one wire so that a continuous length of mineral insulated cable is produced thereby.

9. The method of claim 1 wherein said second step of magnetically separating comprises the steps of:

rotating a magnetic drum shrouded by a stationary film; and directing a flow of the reduced mineral medium onto an upper portion of the stationary film at a location such that the mineral medium will flow by the force of gravity along a contour formed in the stationary film by the rotating magnetic drum to magnetically separate iron particles from the mineral medium to produce the purified mineral medium.

10. The method of claim 9 further including the step of heating the mineral medium to remove absorbed moisture.

* * * * *